United States Patent [19]

Kunst et al.

[11] Patent Number: 4,573,594

[45] Date of Patent: Mar. 4, 1986

[54] RAILWAY CAR UNDERFRAME ADAPTED FOR USE WITH COUPLE OR DRAWBAR CONSTRUCTION

[75] Inventors: Robert J. Kunst, Crown Point, Ind.; Gerald F. Lahey, Kenilworth, Ill.; Herbert S. Wille, Schererville, Ind.

[73] Assignee: Pullman Standard, Inc., Chicago, Ill.

[21] Appl. No.: 532,448

[22] Filed: Sep. 15, 1983

[51] Int. Cl.[4] ..... B61G 7/10; B61G 9/24

[52] U.S. Cl. ..... 213/51; 213/54; 213/62 R; 105/420

[58] Field of Search ..... 213/50, 50.5, 51, 62 R, 213/62 A, 63, 64, 54, 56, 57; 105/420, 416

[56] References Cited

U.S. PATENT DOCUMENTS

| | | | |
|---|---|---|---|
| 1,142,832 | 6/1915 | Miner | 213/63 |
| 1,881,226 | 10/1932 | O'Connor | 213/50 |
| 1,890,795 | 12/1932 | Spencer | 213/50 |
| 2,000,683 | 5/1935 | Akitt | 213/50 |
| 2,039,247 | 4/1936 | Heffelfinger | 213/50 |
| 3,042,224 | 7/1962 | Blattner | 213/64 |
| 3,810,552 | 5/1974 | Girard | 213/8 |
| 3,836,013 | 9/1974 | Hawthorne | 213/54 |
| 3,858,729 | 1/1975 | Altherr | 213/64 |
| 4,343,407 | 8/1982 | Murphy | 213/62 R |
| 4,422,557 | 12/1983 | Altherr | 213/58 |

*Primary Examiner*—Robert B. Reeves
*Assistant Examiner*—Dennis C. Rodgers
*Attorney, Agent, or Firm*—Richard J. Myers

[57] ABSTRACT

A railway car underframe includes a sill structure having at one end a cushion pocket disposed rearwardly of a draft structure which is readily adapted to support a drawbar assembly having at its rear end an impact head extending into the pocket and engaging a cushion. The cushion is spaced from one end of the pocket by a removable spacer assembly which is removed when a larger cushion is disposed in the pocket and a shank coupler assembly is utilized. The draft structure includes attaching means to which a bell mouth housing is removably secured when the coupler assembly replaces the drawbar assembly. The structure includes a member which is a combination having a draft lug function, for coupler application, and a draft keyslot function for drawbar application.

18 Claims, 7 Drawing Figures

RAILWAY CAR UNDERFRAME ADAPTED FOR USE WITH COUPLE OR DRAWBAR CONSTRUCTION

BACKGROUND OF THE INVENTION

1. Field of the Invention

This invention pertains to a railway car underframe which includes at one end of a stationary sill, a cushion pocket and a draft structure which will accommodate alternately either a coupler assembly and associated cushioning device or a drawbar structure and another cushion of different design.

2. Description of the Prior Art

The prior art in connection with this invention is exemplified in U.S. Pat. Nos. 1,142,832, 2,000,683, 2,039,247, 3,810,552 and 3,836,013. U.S. Pat. No. 1,142,832 primarily discloses a drawbar type of construction, a drawbar extension and associated structure. U.S. Pat. No. 2,000,683 is a typical coupler and cushioning arrangement of the prior art. U.S. Pat. No. 2,039,247 discloses an arrangement which eliminates the necessity of having two coupler standards, i.e. a short shank for freight and longer shank for passenger equipment and provides an auxiliary shank which may be connected to a standard drawbar or coupler to give it the desired length. U.S. Pat. No. 3,810,552 includes a universal draft gear pocket for receiving cushioning units of different manufacturers. U.S. Pat. No. 3,836,013 is specific to an improvement in a draft gear pocket which is adapted by means of an adapter to receive a relatively smaller cushion which replaces a larger cushion. The present invention relates to an improved structure which is not found nor described in the prior art.

SUMMARY OF THE INVENTION

The present invention includes a center sill underframe which is provided with a cushion pocket that will accommodate cushioning means of different lengths by the utilization of unique adapter structure readily interchangeable and which will accommodate a drawbar and associated structure or a coupler. The coupler adaptation includes a bell mouth housing which is removably attached to the draft gear structure at the end of the sill adjacent the cushion pocket. An important advantage of the invention lies in the structure of the two combination draft lug and keyslot members which alternately serve as draft lugs for couplers and draft keyslot for drawbars.

DESCRIPTION OF THE PREFERRED EMBODIMENT

Figure 1:
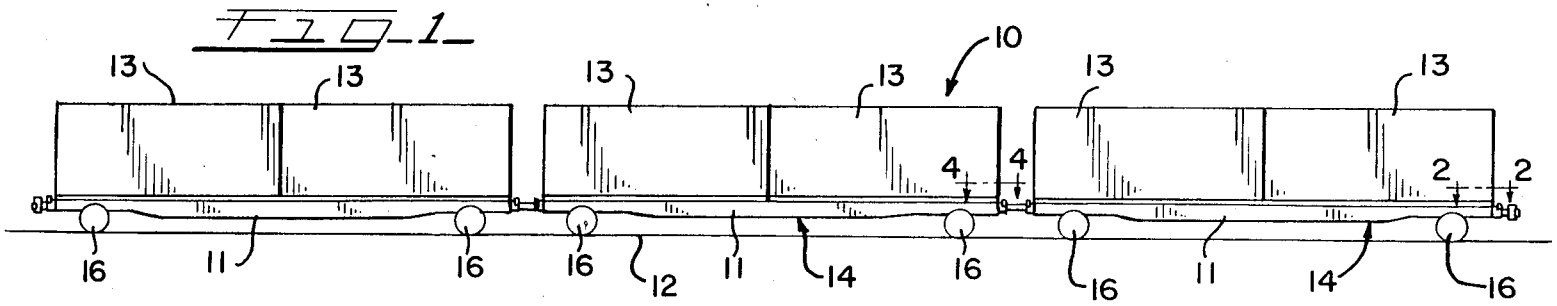
FIG. 1 is a schematic view of a number of railway flat cars which include underframes supported on single axle trucks and are interconnected by shank couplers and drawbars.

FIG. 1 is a side elevational view of a portion of a flat car train 10 including three cars 11 supported on conventional track 12, each car 11 comprising an underframe 14 supporting one or more containers 13. The underframe 14 is of conventional construction including a stationary center sill 15, best shown in detail in FIG. 7. The center sill is in turn supported on conventional single axle car truck assemblies 16 designated in FIG. 1.

Figure 6:
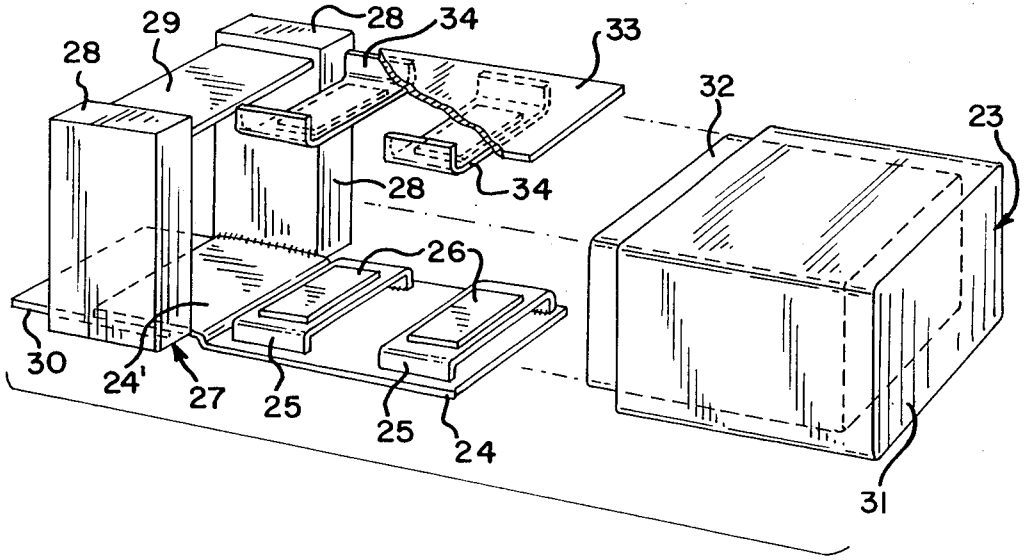
FIG. 6 is an exploded perspective view of the adapter structure within a cushion pocket when used with a drawbar.
Figure 7:
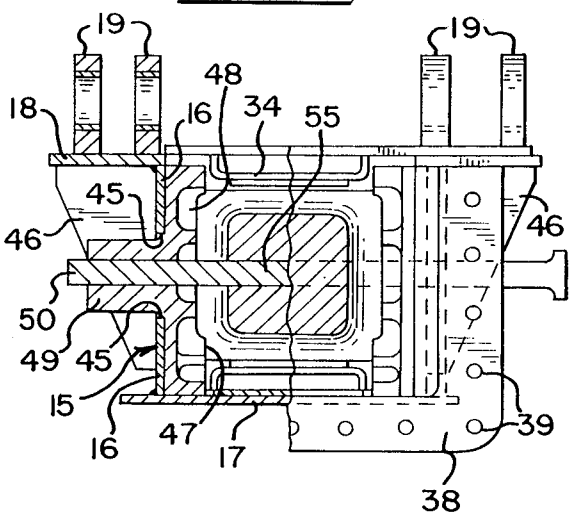
FIG. 7 is a partial elevational cross sectional view taken along the line 7—7 of FIG. 4.
Figure 4:
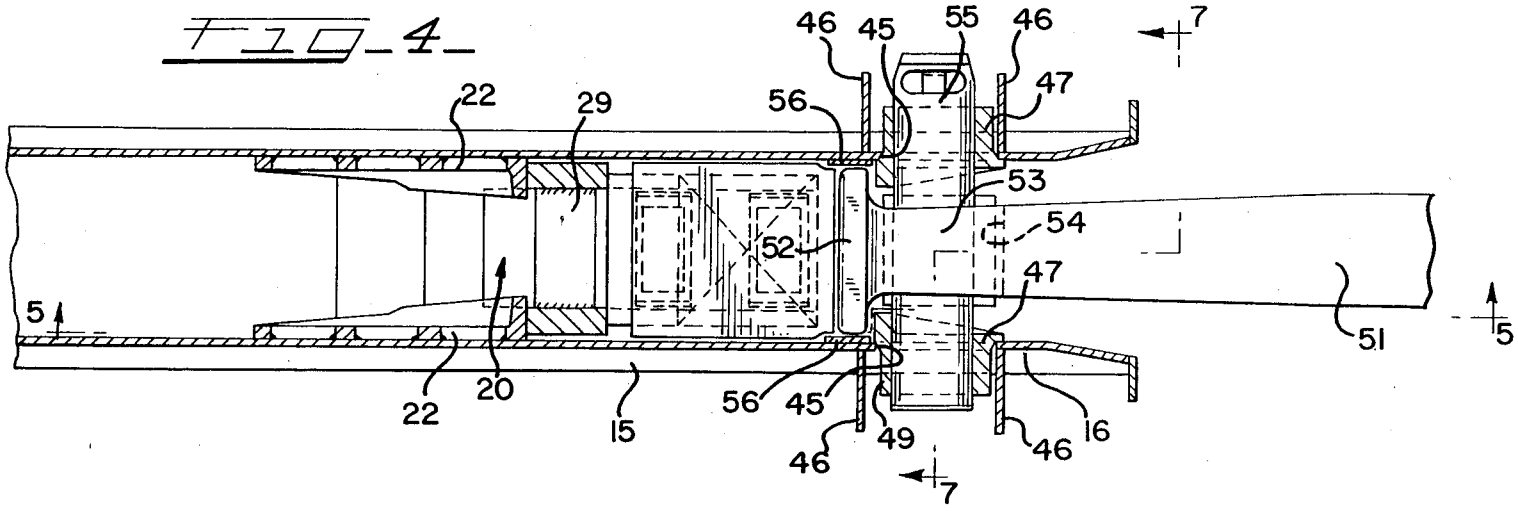
FIG. 4 is a plan view, taken along the line 4—4 of FIG. 1 with the top plate removed, of a draft gear, cushion pocket, and drawbar assembly, disclosing adapter structure within the cushion pocket for accommodating a cushion of lesser length associated with the drawbar.

The center sill 15 comprises upright walls 16 laterally spaced and extending substantially the length of the underframe. As best shown in FIG. 7, the upright walls 16 are connected to a lower wall or plate 17 extending substantially the length of the sill 15. An upper wall or plate 18 also extends substantially the length of the center sill. The plate 18 supports on its upper surface upstanding legs 19. The end of the center sill 15 basically comprises a cushion pocket 20 formed by an opening 21 in the upper plate 18. The pocket 20 is formed by rearmost stop members 22 rigidly welded to the inner portions of the upright walls 16 and thus provide a cushion (or energy absorbing device) stop. A cushion, of any type well known in the art is designated at 23. While not limited to any type of cushion it may consist of a fluid or elastomer type readily adapted for cushioning wherein a drawbar is utilized. The cushion 23 is supported on a carrier plate 24 supported on the lower plate 17 of the center sill. A pair of horizontally spaced spacer brackets 25, which include upper wear plates 26 slidingly support the cushion 23. As best shown in FIG. 6, the cushion 23 being of a shorter length than other cushions provides the need for a spacer which is designated at 27. The spacer 27 is positioned between the cushion 23 and against the stop members 22 as best shown in FIG. 4. The spacer 27 includes vertical block members 28 connected by upper lateral straps 29 and lower straps 30. The carrier plate 24 includes an offset tongue 24' which is secured suitably to the vertical block members 28.

In the type of cushion shown in FIG. 6, it may include a housing 31 within which is positioned a resilient block member 32 which provides for longitudinal in shear compression. In application the end of the cushion 23 upon impact causes the block member 32 to engage and compress against the members 28 thus cushioning the forces during car impact. The housing 31 is horizontally slideable on the wear plates 26. The opening 21 is covered by a suitable top cover plate 33 to which are connected downwardly projecting U-shaped spacer members 34 which engage the top of the cushion 23 to maintain the same in position. The cover plate 33 is secured over the pocket in conventional manner. The spacer members 34 also are provided with downwardly projecting wear plates 26.

Figure 2:
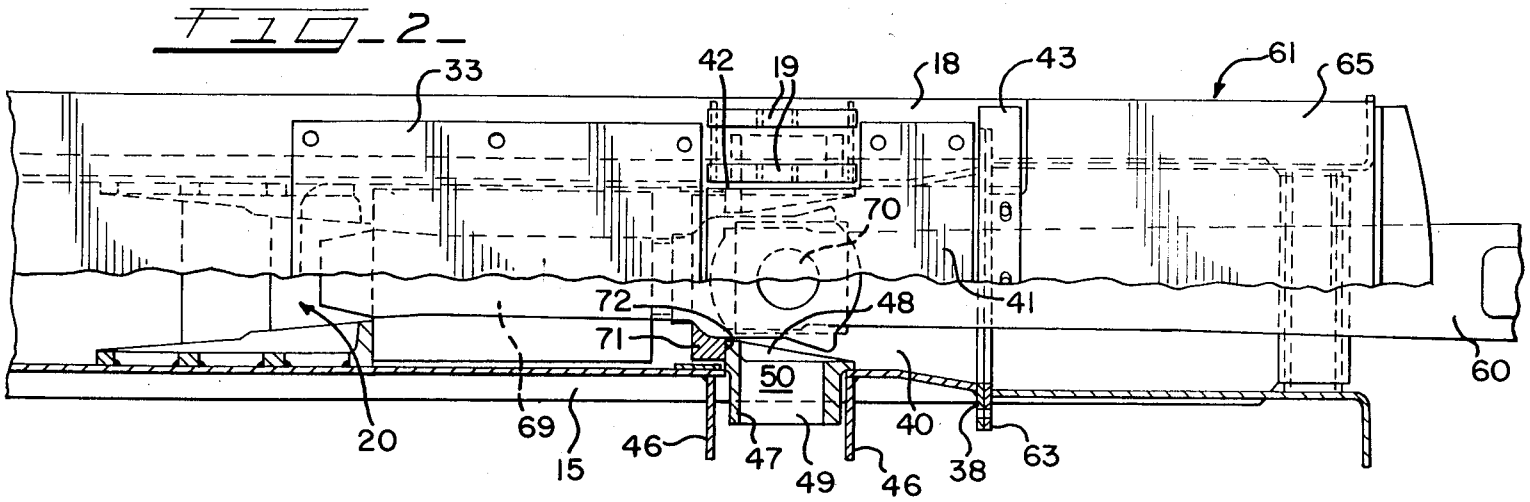
FIG. 2 is a partial plan view of an underframe taken along the line 2—2 of FIG. 1 disclosing a draft gear structure and bell mouth housing which is attached to the underframe to accommodate a long shank coupler.
Figure 5:
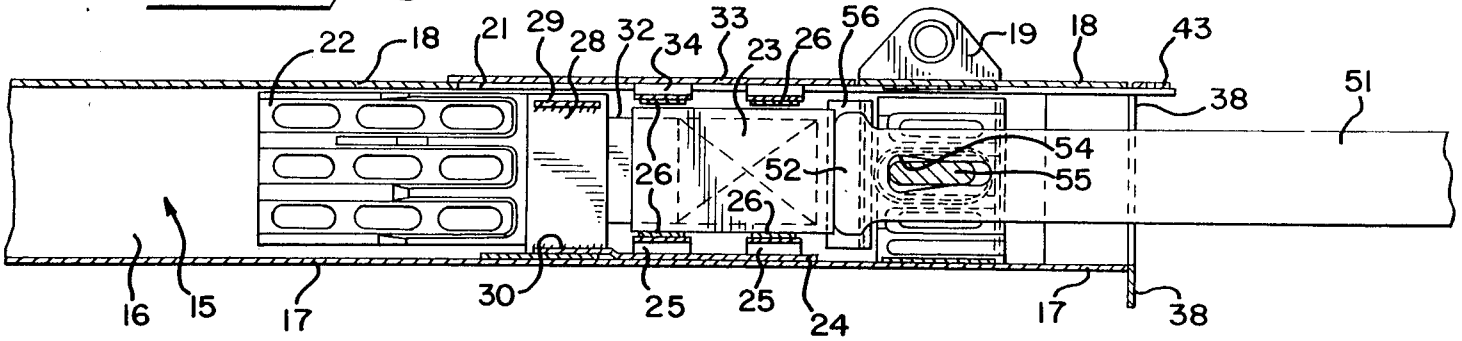
FIG. 5 is a cross-sectional view taken along the line 5—5 of FIG. 4.

As best shown in FIGS. 4 and 5 the front end of the sill 15 forms the draft structure and is provided with an attaching flange 38 having attaching openings 39. The flange 38 extends around and is attached to the end of the sill 15 in U-shaped configuration and is adapted to be attached to a sill extension as will be described hereafter. As best shown in FIG. 2, the top plate 18 of the center sill, adjacent the forward end of the sill is also provided with an opening 40 which is covered by a cover plate 41 of generally T-shaped configuration having a narrower extension 42 extending between the lugs 19 on opposite sides of the top plate 18. A horizontal connecting flange 43 is also secured to the end of the sill 15 and projects outwardly therefrom to provide suitable attaching means for the sill extension which will be described below.

As best shown in FIG. 4 the forward end of the sill 15 includes aligned openings 45 in the side walls 16. Laterally extending plates 46 project outwardly from the side walls adjacent to said openings. Cheek plates 47 are rigidly welded within said openings. The cheek plates 47 include inwardly extending projections or bosses 48, and outwardly extending projections in which slots 50 are formed. Drawbar 51 projects within the center sill and includes an enlarged impact head 52 and a narrow neck portion 53, as best shown in FIGS. 4 and 5. The neck portion 53 is provided with a keyhole slot 54 and a key 55 extending through the slot 54 and the cheek plates 45 connect the drawbar 51 to the sill structure for limited longitudinal movement. This movement is provided by the elongated slot 54 in the end of the drawbar 51.

As best shown in FIG. 5 vertical spacer and wear plates 56 are welded to the inner sides of the vertical center sill plates adjacent to the impact head 52.

Drawbar Operation of the Structure of FIGS. 4 and 5

In the embodiment of FIGS. 4 and 5 when the drawbar 51 is in draft the key 55 is against the rear end of the slot 54 and the rail car and underframe are being pulled along. During impact or braking forces on the drawbar, the impact head 52 compresses the cushion which is in abutment with the spacer 26, which in turn is held against the stop members 22. The cushion 23 slides on the wear plates 26 and is held against vertical displacement by the wear plates 26 secured to the cover 33. The key 55 is firmly held in the cheek plates 47 which by virtue of the projections 49 and 47 are securely fixed against movement.

Figure 3:
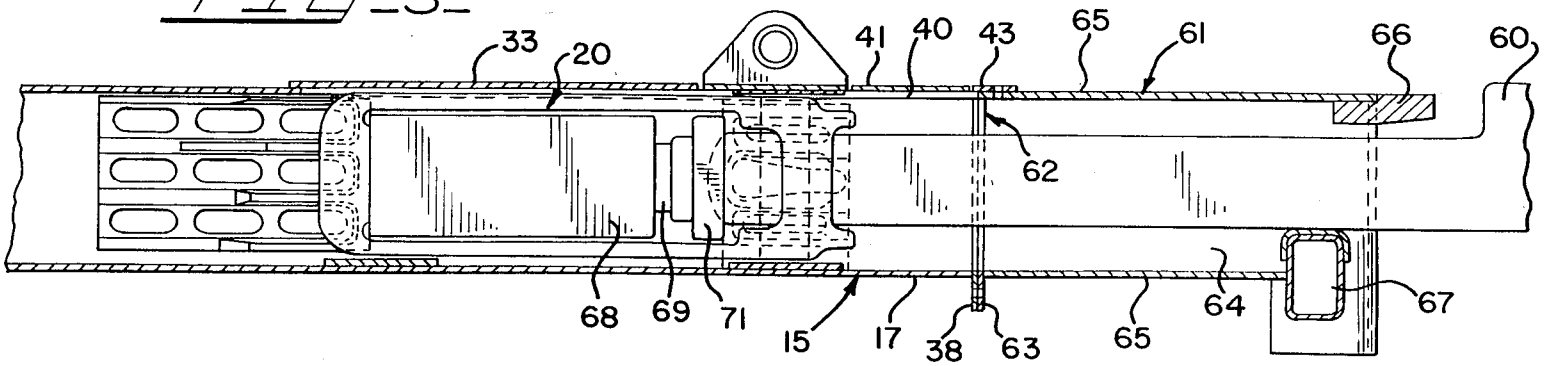
FIG. 3 is a cross sectional view of the arrangement disclosed in FIG. 2.

The change in the construction when a long shank coupler is utilized will now be described. Essentially the construction is very similar but certain changes are disclosed in FIGS. 2 and 3 will have to be made. The spacer 26, small cushion 23, carrier plates 25 and 34 are removed as well as the wear pads 26. The cover 33 may be the same. The key 55 is removed and the cheek plates 49 remain in place. A long shank coupler 60 is added to the arrangement. A bell mouth housing 61 includes a rear attaching flange arrangement 62 comprising horizontal upright flanges 63 which are connected by suitable fasteners to the flanges 38 and 43 of the end sill or draft structure. Thus the bell mouth housing 61 is securely fastened to the end of the sill. The housing 61 includes vertical wall portions 64 and horizontal wall portion 65 conforming to the end of sill construction of the underframe. A striker member 66 is connected to the forward end of the housing 61. A transversely extending coupler support 67 supports the forward end of the long shank coupler 60. The coupler 60 is connected to a draft gear (or cushion, or energy-absorbing device) of conventional design designated at 68. The gear 68 extends the length of the pocket 20 since the small cushion equipment has been removed. A plunger 69 projects rearwardly from a pivotal connection 70 to the coupler 60. The plunger extends into the draft gear housing 68 in conventional fashion and on impact cushions the forces applied to the coupler. On draft the coupler moves forwardly and a follower block 71 engages the thrust surfaces 72 provided on the projections 48 of the cheek plates 49.

Thus in the operation of the coupler application certain of the cushioning elements are removed and replaced while a bell housing extension is added. The cheek plates are of a construction affording double duty or use in either coupler or drawbar application. This change is simple, effective, and can be quickly accomplished.

We claim:

1. A railway car underframe including a center sill having an end part, a railway car draft connecting means, a cushioned draft structure being supported on said end part and adapted to accommodate the railway car connecting means in the form of a coupler or a drawbar, said sill end part including an inner portion and an outer portion, said draft structure including a cushion pocket in said sill outer portion, stop means in said sill inner portion adjacent said cushion pocket, cushioning means supported in the cushion pocket and engageable with the railway car connecting means for cushioning loads received therefrom, said sill outer portion having sill walls and draft lug cheek means being supported therein, said draft lug cheek means having key slot means adaptable to receive an associated key means therethrough, draft lug engaging means being operatively connected with the railway car connecting means, said draft lug engaging means being disposed between the cushion pocket and the draft lug cheek means and engaging the draft lug cheek means during movement of the draft lug engaging means in a direction outwardly of the sill end part upon imposition of draft forces on the draft lug engaging means, and attaching means on the sill outer portion, said attaching means being adapted to be releasably connected to a sill extension having coupler support means when the railway car connecting means is in the form of a coupler.

2. A railway car underframe in accordance with claim 1, said cushioning means when utilized with a drawbar including a cushion and spacer means disposed within the cushion pocket between the stop means and the cushion.

3. A railway car underframe in accordance with claim 2 including spaced carrier plates supported in said cushion pocket below said cushion and supporting the same.

4. A railway car underframe in accordance with claim 3 said carrier plates including wear strips supported on said carrier plates.

5. A railway car underframe in accordance with claim 4 said pocket including a removable cover plate including downwardly projecting spacer plates.

6. A railway car underframe in accordance with claim 5 said downwardly projecting spacer plates including wear strips.

7. The invention according to claim 1, and said cushion pocket including a removable cover plate means providing access to the cushion pocket for replacement of the railway car connecting means and cushioning means in changing between drawbar and coupler operation.

8. The invention according to claim 1, and said cushion pocket being provided with means adapted to receive said cushioning means for limited cushioned movement relative to the draft structure of said railway car connecting means in the form of a coupler, said cushion pocket being provided with further means to adapt another cushioning means of lesser length than the first mentioned cushioning means when the first cushioning means is removed from the pocket and the connecting means takes the form of a drawbar.

9. In a railway car underframe including a center sill having upright spaced sill walls defining a cushion pocket having at one end thereof a cushion stop, a cushion within said cushion pocket, a drawbar supported on said underframe and projecting into said cushion pocket, said drawbar having a laterally extending slot, an impact head at one end of said drawbar engageable with said cushion, a cheek plate assembly comprising a pair of vertical spaced cheek members respectively supported on said sill walls, each of said spaced cheek members including a transversely extending slot with said slots being in registry with said drawbar slot, a key extending through said slots, said drawbar slot being longer lengthwise than said cheek member slots, said cheek members having inwardly projecting boss members, the boss members defining a space therebetween, said space communicating with the cushion pocket and being transversely narrower than the impact head of the drawbar, the drawbar extending through said space, the impact head of the drawbar being entrapped by said boss members in said cushion pocket against longitudinal movement between the cheek members, the boss members having impact receiving surfaces facing said cushion pocket, said impact head having laterally spaced thrust surfaces engageable with said impact receiving surfaces during draft movement of said drawbar.

10. A railway car underframe in accordance with claim 9, said plate members extending through said sill walls.

11. A railway car underframe in accordance with claim 10, said slots having a key-shaped configuration.

12. The railway car underframe in accordance with claim 9, said boss members including inner surfaces diverging outwardly within said center sill.

13. The railway car underframe in accordance with claim 12, said cushion being of lesser length than said pocket and spacer means between one end of said cushion and one end of said pocket.

14. The railway car underframe in accordance with claim 9, said center sill including attaching means adapted to be connected to a housing assembly for carrying a coupler adapted to be connected with a cushion means within said cushion pocket.

15. In a railway car underframe including a center sill having upright spaced sill walls defining a cushion pocket having at one end thereof a cushion stop, a cushion within said cushion pocket, a drawbar supported on said underframe and projecting outwardly with respect thereto, said drawbar having a laterally extending slot, an impact head at one end of said drawbar engageable with said cushion, a cheek plate assembly comprising a pair of vertical spaced cheek members respectively supported on said sill walls, each of said spaced cheek members including a transversely extending slot with said slots being in registry with said drawbar slot, a key extending through said slots, said drawbar slot being longer lengthwise than said cheek plate slots, said cheek members having inwardly projecting boss members having impact receiving surfaces facing forward end of said cushion pocket, said impact head having laterally spaced thrust surfaces engageable with said impact receiving surfaces during draft movement of said drawbar, said boss members including inner surfaces diverging outwardly within said center sill, said pocket accommodating a cushion of lesser length and including spacer means between one end of said cushion and one end of said pocket, and said pocket having an opening and including a removable cover and spacer plates projecting downwardly from said cover for securing said cushion within said pocket.

16. In a railway car in accordance with claim 15, including wear plates in said pocket supporting said cushion.

17. In a railway car underframe including a center sill, a draft structure supported on one end of said center sill adapted to alternately accommodate a coupler and draft gear or cushioned drawbar assembly, said draft structure including a cushion pocket spaced from one end of said center sill, said cushion pocket including laterally spaced upright sill walls and upper and lower horizontal walls connected to said upright sill walls, stop means on said upright sill walls adjacent the rear end of said cushion pocket said sill walls extending forwardly of said cushion pocket to provide on said draft structure an attaching assembly for a sill extension, said attaching assembly including first securing means, a sill extension removeably connected to said securing means, said sill extension comprising a bell mouth housing, a striker block on one end of said bell mouth housing and a coupler carrier, a coupler carried by said coupler carrier projecting into said cushion pocket, a cushion within said pocket, said coupler being connected to said cushion to cushion impact forces, a cheek plate assembly forwardly of said cushion pocket, said cheek plate assembly including a pair of cheek plate members having inwardly projecting bosses supported on the sill walls, a thrust member connected to said coupler and connected to said cushion, and a follower block on said thrust member engageable with said bosses in draft to provide draft forces on said underframe.

18. In a railway car underframe including a center sill having upright spaced sill walls defining a cushion pocket having at one end thereof a cushion stop, a cushion within said cushion pocket, a drawbar supported on said underframe and projecting outwardly with respect thereto, said drawbar having a laterally extending slot, an impact head at one end of said drawbar engageable with said cushion, a cheek plate assembly comprising a pair of vertical spaced cheek members respectively supported on said sill walls, each of said spaced cheek members including a transversely extending slot with said slots being in registry with said drawbar slot, a key extending through said slots, said drawbar slot being longer lengthwise than said cheek plate slots, said cheek members having inwardly projecting boss members having impact receiving surfaces facing the outward end of said cushion pocket, said impact head having laterally spaced thrust surfaces engageable with said impact receiving surfaces during draft movement of said drawbar, said pocket having an opening and a removable cover means providing access to the cushion pocket for replacement of the drawbar and the cushion with a coupler and a cushioning means for changing between drawbar and coupler operation.

* * * * *